United States Patent [19]

Combet

[11] Patent Number: 4,588,037

[45] Date of Patent: May 13, 1986

[54] TURRET FOR ROOF BOLTING APPARATUS

[75] Inventor: Michel Combet, Caluire, France

[73] Assignee: Envirotech Corporation, Salt Lake City, Utah

[21] Appl. No.: 680,617

[22] Filed: Dec. 11, 1984

[30] Foreign Application Priority Data

Dec. 16, 1983 [FR] France ..... 83 20730

[51] Int. Cl.[4] ..... E21C 9/00; E21D 20/02

[52] U.S. Cl. ..... 175/220; 173/43; 405/259; 405/303

[58] Field of Search ..... 175/220, 202, 203, 161, 175/51; 173/43, 44, 29, 50; 405/259, 260, 261, 303

[56] References Cited

U.S. PATENT DOCUMENTS 3,246,705 4/1966 Chappuis ..... 173/44
4,201,270 5/1980 Ribich et al. ..... 405/259 X
4,215,953 8/1980 Perraud ..... 405/303
4,229,124 10/1980 Frey et al. ..... 405/303
4,398,850 8/1983 Talvensaari ..... 173/43 X

*Primary Examiner*—Stephen J. Novosad
*Attorney, Agent, or Firm*—Carl A. Rowold

[57] ABSTRACT

This turret has a head 6 enabling, after the drilling of a hole 15, the injection of a resin cartridge without modifying the position of the turret 1. A movable member 8, displaced by a jack 14, has a first passage 11 traversed by the drilling rod 4, and a second passage 12 connected to the hose 13 for the injection of resin cartridges. After the drilling of the hole 15 and the retraction of the drilling apparatus 2, the movable member 8 is displaced such that the drilling rod 4 is laterally retracted by bending. The second passage 12 is simultaneously brought in line with the axis of the hole 15 so as to enable the injection of one or more resin cartridges.

6 Claims, 9 Drawing Figures

TURRET FOR ROOF BOLTING APPARATUS

BACKGROUND OF THE INVENTION

The present invention relates to a forward turret of a drilling apparatus or so-called "roof bolter", particularly for use in drilling a hole in the roof of a mine, and enabling the injection of resin cartridges or the like in the hole to secure one end of a bolt in the hole and enabling the other end to support the roof of a mine gallery.

Former support techniques include the use of expansion bolts having expandable anchor members at one end thereof. With the bolt inserted in the hole, the bolt is rotated to secure the bolt in the base of the hole by means of expansion, and after which further tightening of this bolt causes the compression of the ground in the form of a column coaxial to the said bolt. To carry out the drilling of the hole, the positioning of the bolt and the tightening of the bolt, it is known to use an apparatus comprising a pivoting turret supporting a drilling carriage and a bolting carriage. The first of these carriages is a drilling machine which enables the initial drilling of the hole, after which the turret is rotated about its pivot axis such that the second carriage is brought into the axis of the previously drilled hole for the insertion and tightening of the bolt. Apparatus of this type is disclosed in particular in U.S. Pat. No. 3,246,705.

Developments in support techniques led to the replacement of the expansion bolts by resin-sealed bolts. The resin used takes the form of elongate cartridges. These may be inserted manually into the previously drilled hole, before the positioning of the bolt. However, the manual insertion of the cartridges requires time and skilled operators. In addition, it is difficult to carry out if the roof of the mine is particularly high. It has therefore been attempted to reduce the manual work required for this operation by adding a resin cartridge injection device to the drilling and bolting turrets. After the hole has been drilled, the turret is pivoted into an intermediate position in which the cartridge injection device is located in the axis of the bolt. One or more cartridges are then inserted into the hole by mechanical or pneumatic means. Finally, a further pivoting of the turret brings the bolting carriage into the axis of the hole into which the resin cartridges have been inserted. A "three-position" turret of this type is disclosed, for example in the Published German Pat. No. 2 222 646. However, with the turret of "three-position" type, there is always a risk, despite the fact that the turret is anchored in the roof along its pivoting axis, that after the first rotation of the turret the cartridge injection device may not be brought exactly into the axis of the hole drilled in the initial position of the turret. In order to avoid this problem, it has already been envisaged to provide a turret in which the drilling of the hole and the injection of the cartridges are carried out successively without moving the turret. For this purpose, the forward head of the turret is provided with a first passage for the drilling rod and a second passage for the admission of the resin cartridges, this second passage intersecting and opening into the first passage at an angle of approximately 30° see U.S. Pat. No. 4,398,850. After drilling of a hole, the drilling rod is therefore retracted and, without displacing the turret which remains anchored to the rock, the resin cartridge(s) are injected into the hole via the second passage and then the first passage of the turret head. A single rotation of the turret is then sufficient to bring it into a second position enabling bolting. This enables the structure of the turret to be simplified as compared to the "three-position" turret.

However, in the case of the two-passage turret head each cartridge of resin must pass, during its travel, through a bend which is fairly pronounced and which corresponds to the connection between the two passages provided in the forward head of the turret. This leads to various drawbacks including the following:

Deflection of the cartridge with respect to the theoretical axis of injection during passage through the bend, this phenomenon being amplified by wear of the outer end of the first passage in the forward head with the result that the deflected cartridge tends to catch on the inlet of the drilled hole.

Friction of the cartridge against the walls of the forward head passages, this friction required the use of reinforced cartridges and causing a loss of kinetic energy preventing full penetration of the cartridge into the drilled hole (i.e., to the base of the hole). This drawback is particularly great when several cartridges are to be injected into the same hole.

As the cartridge injection passage communicates with the drilling rod passage, the flexible injection hose which delivered the resin cartridge to the cartridge injection passage is not sheltered from rock debris and water resulting from the drilling operation. It is then necessary to blow compressed air through this hose during and/or after drilling, which leads to a loss of time and causes the operator and the apparatus to be sprayed with water and debris.

The forward turret head having its two passages connected in the form of an elbow joint, is of comparatively large size, in particular in the longitudinal direction of the turret which limits the travel of the drilling machine.

The forward turret head must be completely replaced if it is desired to drill holes and inject cartridges having different diameters.

SUMMARY OF THE INVENTION

The present invention obviates the above-noted drawbacks of the two-passage turret head. For this purpose, this invention essentially relates to a forward turret of a drilling apparatus, enabling the injection of resin cartridges or the like after drilling of a hole without modification of the position of the turret occupied during the drilling operation. This forward turret has a head comprising a guide member which is mounted to be movable in a direction which is substantially transverse to the direction of the drilling rod, the movable guide member comprising a first passage adapted to receive the drilling rod and a second passage, which is completely separate from the first, and is connected to the end of the resin cartridge injection hose. Means are further provided for the displacement of the movable guide member between a drilling position, in which its first passage is located on the axis of an aperture in the end of the head, and an injection position, in which its second passage is brought into the axis of the aperture. In the injection position, the drilling rod engaged in the first passage of the movable guide member is then laterally retracted by bending.

When the movable guide member of the head is in its first or drilling position, the drilling rod may be pushed through the first passage of this movable guide member and the aperture in the head for the drilling of the hole. After retraction of the drilling apparatus, the drilling rod is retracted to the side by the displacement of the movable guide member which is actuated by a jack or like control means. The second passage to which the end of the injection hose is connected, is simultaneously positioned facing the aperture in the body of the head and therefore faces the previously drilled hole. The injection of the cartridge then takes place in alignment with the drilled hole with no bend in the path of the cartridge and therefore no risk of deflection with respect to the hole and with very little friction which limits the kinetic energy of the cartridge and improves its depth of penetration in the hole. Consequently, the wear of the drilling rod passages also has little effect on the successful injection of the cartridge.

In addition, by means of this invention, the cartridge injection hose is distanced from the axis of the hole in the drilling position of the movable portion of the head, and is therefore sheltered from the rock debris and water produced by the drilling. This avoids the need to clean the hose with compressed air during and/or after the drilling, and therefore reduces time losses and prevents the operator and the apparatus from being sprayed with water and debris.

In accordance with a particular embodiment of this forward turret of a drilling apparatus, the movable guide comprises a first member which includes the passage designed to be traversed by the drilling rod and which is mounted slidably on the body of the head in a direction perpendicular to the direction of the drilling rod, and a second member which comprises the passage connected to the end of the injection hose. The second member is mounted on the body of the head so as to pivot about an axis perpendicular to the direction of movement of the drilling rod, with mechanical connection means being provided between the sliding member and the pivoting member. In one embodiment, there is provided a jack articulated on one end on the body of the forward head and, on the other end on the pivoting member, for the purposes of displacing this pivoting member directly between the two positions. In addition, a connection rod is articulated, on one hand, on the sliding member and, on the other hand, on the pivoting member so as to transmit the movement of the latter to the sliding member.

This construction enables the head to be made of a length which is less than that of a two-passage turret head whilst improving the guide length of the drilling rod which is important with respect to the straightness of the hole, the wear of the forward head and the service life of the drilling rods, and which enables the travel of the drilling apparatus to be increased. A free space may be provided between the sliding member traversed by the drilling rod and the pivoting member connected to the resin cartridge injection hose, so that during passage from the drilling to the injection position, rock debris and water which may have been trapped by the forward head are automatically ejected towards the base of the turret or slideway, which enables the cartridge to be injected without the need for preliminary cleaning using compressed air.

Finally, the configuration of the forward turret drilling head of the invention provides for the drilling of holes and the injection of cartridges of different diameters, simply by the replacement of the wearing parts whilst retaining the body of the forward head.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2, 3, 4:
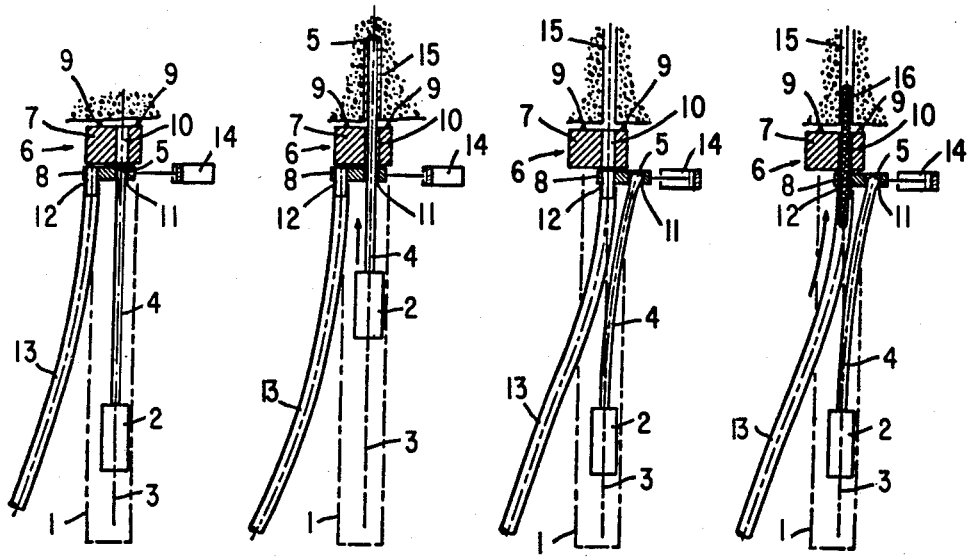
FIGS. 1, 2, 3 and 4 are outline diagrams of a forward head of the invention, shown in the various successive positions of the cycle for drilling a hole and injecting a resin cartridge.

FIGS. 1 to 4 show, in diagrammatic form, a drilling turret 1 supporting a drilling apparatus 2 which is displaced along a longitudinal axis 3 and a drilling rod 4 having a bit 5 at its end. The forward head of the turret, shown generally at 6, which is the subject matter of the present invention is at the end of the turret 1.

The forward head 6 of the turret comprises a fixed upper body member 7 and a lower guide member 8 which is movable with respect to the body 7 in a direction substantially transverse to the axis 3. The body 7 of the forward head 6 is provided with pointed projections or tongs 9 so that it can be anchored to the mine roof, and comprises a guide aperture 10 provided along the axis 3.

The movable member 8, located below the body 7, has two separate passages 11 and 12. The first passage 11 has the form of a simple aperture, whereas the second passage 12 is connected to the end of a flexible hose 13 designed for the injection of resin cartridges. A double-acting jack 14 is attached to the movable member 8 to move it between the two operating positions.

As the forward head 6 is anchored to the mine roof by the tongs 9, the movable member 8 is initially positioned in the drilling position, in which the axis of its first passage 11 is positioned along the axis 3—see FIG. 1. The drilling apparatus 2 is then actuated so as to push the drilling rod 4 through the first passage 11 of the movable portion 8 and the aperture 10 of the body 7 of the head 6 so as to carry out the drilling of the hole 15—see FIG. 2.

After drilling of the hole 15, the drilling apparatus 2 is retracted until the drilling rod 4 is released from the body 7. When the bit 5 of the rod 4 reaches the level of the first passage 11 of the movable member 8, the drilling apparatus 2 is stopped. The jack 14 is then actuated so as to displace the movable portion 8 towards the injection position, in which the drilling rod 4 is retracted to the side by bending, as shown in FIG. 3.

Simultaneously, the displacement of the movable member 8 brings the second passage 12 of the latter into the axis 3, as an extension of the aperture 10 of the body 7. The end of flexible hose 13 is then located opposite the previously drilled hole 15, and this hose 13 then enables the injection of a resin cartridge 16 into the hole 15 using compressed air or any other means—see FIG. 4.

The jack 14 is then actuated in the reverse direction so as to bring the drilling rod 4 completely back into the axis 3 to its initial position. An anchoring bolt may then be fitted. In the case of a drilling and bolting turret, this turret is pivoted so as to bring the bolting carriage into the axis of the drilled hole 15.

The movable guide member 8 of the forward head 6, shown as a monobloc sliding member in the outline diagrams of FIGS. 1 to 4, comprises two separate members in the particular embodiment shown in FIGS. 5 to 9. These Figs. show, in a detailed manner, the forward head 6 with its body 7, its connection 17 for fastening to the turret or and its anchoring tongs 9.

The movable guide member 8 comprises a first member 18 mounted slidably in the guideways 19 of the body 7 in a direction perpendicular to the axis 3. The sliding member 18 comprises the passage 11 which is traversed by the drilling rod 4.

The second member of the movable guide 8 is a member 20 mounted pivotably on the body 7 about an axis of rotation 21 perpendicular to the axis 3, such that this member 20 is displaced in the same plane as the sliding member 18. The pivoting member 20 comprises the passage 12 provided with a connector 22 for the fastening of the end of the flexible cartridge injection hose 13—see FIGS. 7 and 8.

Figure 9:
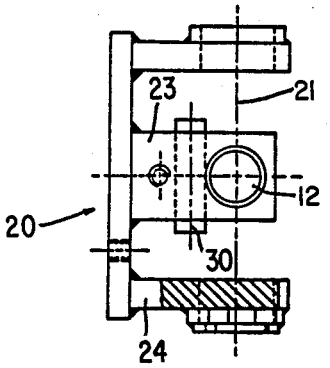

The pivoting member 20, shown on its own in FIG. 9, comprises a central block 23 containing the passage 12 and mounted on a fork-shaped lever 24. This is pivotably mounted on two journals 25 located on either side of the body 7. The control jack 14 is articulated, on one hand, about an axis 26 on the body 7 and, on the other hand, about an axis 27 on one of the two arms of the fork 24.

The sliding member 18 is connected to the pivoting member 20 by means of two parallel connecting rods 28 articulated, on one hand, about a common axis 29 on the sliding member 18 and, on the other hand, about a common axis 30 on the central block 23 of the pivoting member 20.

The jack 14 therefore controls the rotation of the pivoting member 20 about the axis 21 directly, and the pivoting member 20 transmits its movement, via the connecting rods 28, to the sliding member 18 in order to displace the latter along the slideways 19.

Figure 5:
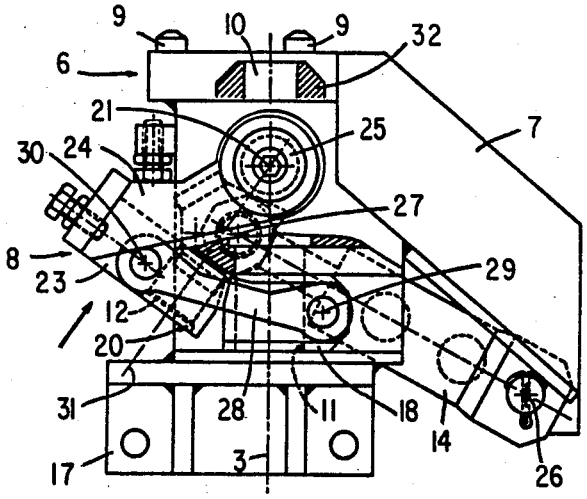
FIG. 5 is a detailed side view, in partial cross-section, of the head of the invention shown in the drilling position.
Figure 7:
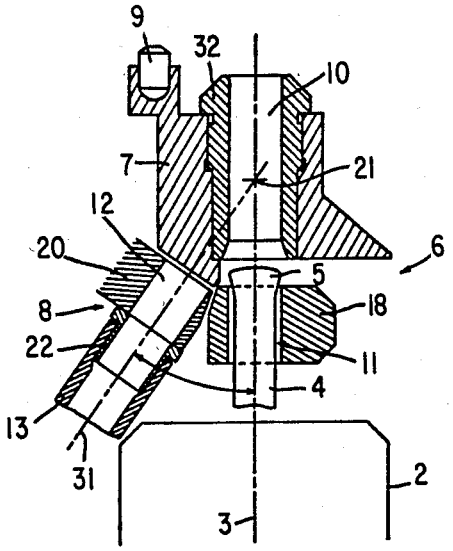
Figure 6:
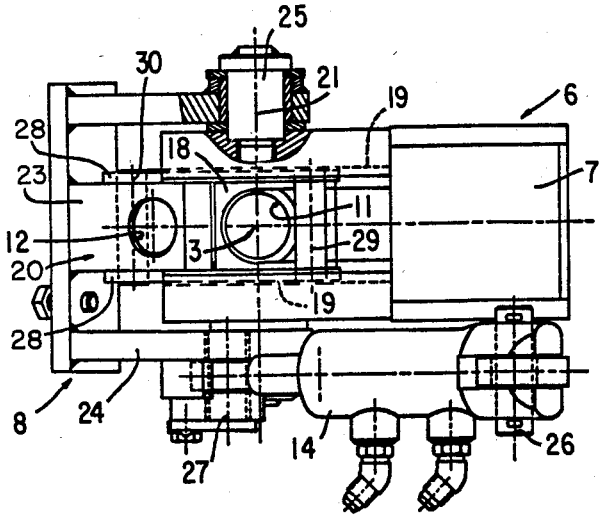
FIG. 6 is a plan view, from below, in partial cross-section corresponding to FIG. 5, FIGS. 7 and 8 are diagrammatic sections of the forward head of FIGS. 5 and 6, in the drilling and injection positions respectively, FIG. 9 solely shows the pivoting member connected to the injection hose, in the direction of the arrow F of FIG. 5 and in partial cross-section.

FIGS. 5, 6 and 7 show the sliding member 18 and the pivoting member 20 in the drilling position. The passage 11 of the sliding member 18 is then centered on the axis 3, whereas the axis 31 of the passage 13 of the pivoting member 20 forms an angle ($\alpha$), for example approximately 35°, with the axis 3. In this drilling position, as shown in FIG. 7, the end of the flexible injection hose 13 is sufficiently offset to the side to enable the nose of the drilling apparatus 2 to be brought very close to the forward head 6.

Figure 8:
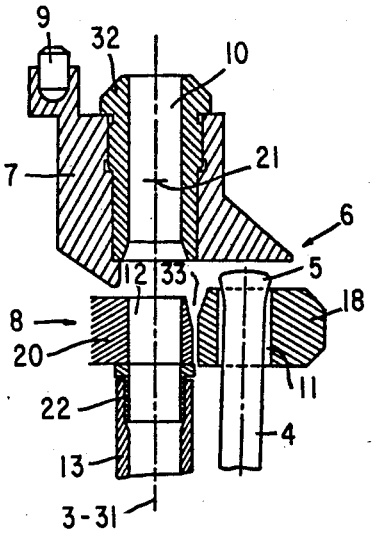

In the injection position, shown in FIG. 8., the sliding member 18 is laterally offset so as to distance the drilling rod 4 from the axis 3 by bending, in accordance with the principle described above. The rotation of the pivoting member 20 has then brought the axis 31 of its passage 12 into alignment with the axis 3.

FIGS. 7 and 8 show, moreover, that the body 7 of the forward head 6 receives a detachable guide sleeve 32 which defines the guide aperture 10. In order to change the drilling diameter, it is simply necessary to replace the guide sleeve 32 by another sleeve and to replace the sliding member 18, the body 7 remaining in position.

Finally, it should be noted that there is a free space 33 between the sliding member 18 and the pivoting member 20 which, if sufficiently large, enables the removal, under the effect of gravity, of rock debris and water, during passage from the drilling to the injection position.

It is obvious that the invention is not limited to the single embodiment of this turret of a drilling apparatus described above by way of example. The invention covers all constructional and operational variants based on the same principle. Thus, it would not lie outside of the scope of the invention to use equivalent means, for example by replacing the jack by any other control means, or to vary the purpose of use of the invention and replace the resin cartridges by similar products.

I claim:

1. A turret for drilling apparatus enabling the injection of resin cartridges after drilling of a hole in a roof of a mine without moving the turret, the turret comprising a drilling rod having a drilling bit at its upper end and movable toward and away from the mine roof for drilling a hole therein and a head having a fixed member engageable with the mine roof and having a guide aperture therein, and a guide movable generally transversely of the direction of movement of the drilling rod, the movable guide having a first passage adapted to receive the drilling rod and a second passage, separate from the first, adapted to receive a cartridge of resin from a source thereof, means for moving the guide between a drilling position, in which the first passage is axially aligned with the guide aperture in the fixed head member and with the drilling rod being movable through the first passage and the aperture, and an injection position in which the second passage is in axial alignment with the guide aperture, with a resin cartridge being movable through the second passage and the aperture.

2. A turret as set forth in claim 1 wherein with the movable guide in its injection position, an end of the drilling rod is retained in its first passage and is positioned away from the guide aperture.

3. A turret as set forth in claim 2 wherein the drilling rod is subject to bending when the movable guide is moved from its drilling to its injection position.

4. A turret as set forth in claim 1 wherein the movable guide comprises a first member mounted for reciprocating motion relative to the fixed head member and having said first passage therein, a second member mounted for pivoting motion relative to the fixed head and having said second passage therein, and a mechanical interconnection between the reciprocating and pivotable members.

5. A turret as set forth in claim 4 wherein said means for moving the guide means comprises means for pivoting said pivotable member, the mechanical interconnection causing the reciprocating member to move along with the pivotable member, when the latter is pivoted.

6. A turret as set forth in claim 1 wherein the fixed head member has a bore therein and further comprises a guide sleeve detachably secured in the bore, the axial passage in the guide sleeve constituting the guide aperture for the drilling rod and resin cartridge.

* * * * *